United States Patent [19]

Kleiner

[11] 4,417,604

[45] Nov. 29, 1983

[54] METHOD AND DOBBY FOR SYNCHRONIZING ALL HEDDLE FRAMES OF A WEAVING MACHINE

[75] Inventor: Walter Kleiner, Hirzel-Zurich, Switzerland

[73] Assignee: Staeubli Ltd., Horgen-Zurich, Switzerland

[21] Appl. No.: 292,107

[22] Filed: Aug. 11, 1981

[30] Foreign Application Priority Data

Aug. 18, 1980 [CH] Switzerland ..... 6202/80

[51] Int. Cl.[3] ..... D03C 15/04; D03C 1/00

[52] U.S. Cl. ..... 139/329; 139/68; 139/324

[58] Field of Search ..... 139/329, 331, 324, 1 E, 139/68; 66/233

[56] References Cited

U.S. PATENT DOCUMENTS 2,856,964 10/1958 Bergstrom et al. ..... 139/329 X
3,002,535 10/1961 Bergstrom et al. ..... 139/324
3,407,848 10/1968 Fumat ..... 139/324 X

FOREIGN PATENT DOCUMENTS 333144 11/1958 Switzerland .
352638 4/1961 Switzerland ..... 139/68

*Primary Examiner*—James Kee Chi
*Attorney, Agent, or Firm*—Flynn, Thiel, Boutell & Tanis

[57] ABSTRACT

A method and apparatus for synchronizing all heddle frames of a weaving machine which are operated by a punched-card-controlled dobby. The pattern card cylinder or the reading needles are moved to positions in which during a read, all the reading needles simultaneously engage the pattern card webs between the control points or the holes of the pattern card. Through this, the heddle frames are moved to the lower shed position by further operation of the dobby.

In a preferred embodiment, the card cylinder is stopped in the center of the indexing movement effected by the driving projection of the drive shaft. The driving projection is laterally uncoupled from a ratchet gear by a hand lever and, simultaneously, further movement of the ratchet gear is prevented by the engagement of a locking member in a tooth space of the ratchet gear.

18 Claims, 11 Drawing Figures

Fig.1
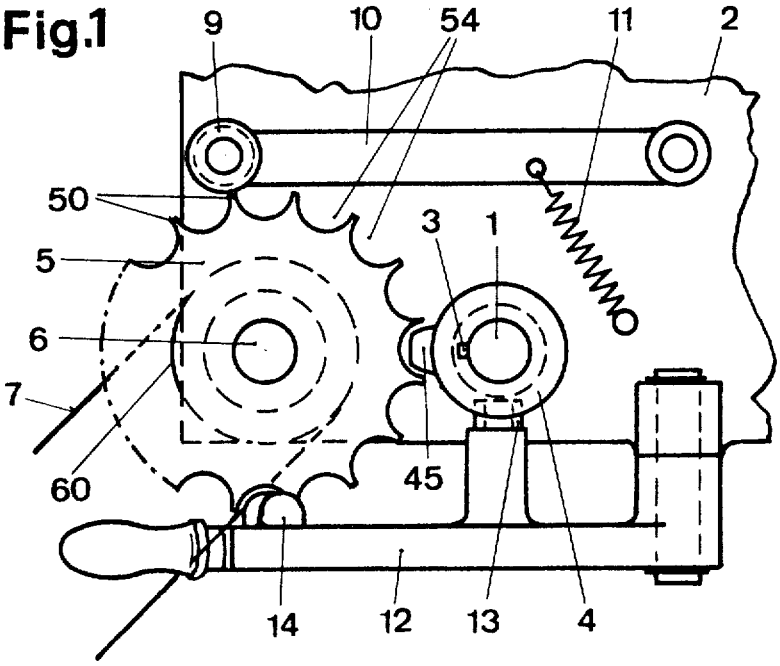
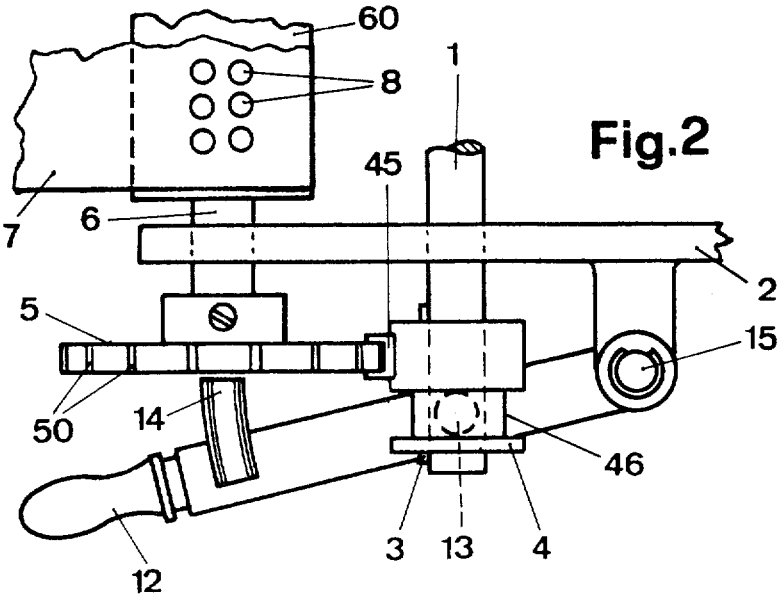
Fig.2

METHOD AND DOBBY FOR SYNCHRONIZING ALL HEDDLE FRAMES OF A WEAVING MACHINE

FIELD OF THE INVENTION

This invention relates to a method and apparatus for synchronizing all heddle frames of a weaving machine which are driven by a perforation-controlled dobby.

BACKGROUND OF THE INVENTION

In many conventional weaving machines, a dobby is used in which the patternlike control is effected by a pattern card with control points which are holes and nonperforated points and are read by reading members, the pattern card moving in front of the reading members.

In order to make the tying of warp threads easier or to equally tension these during a longer standstill of the weaving machine, it is preferable that the heddle frames be synchronized or levelled, namely, that they be placed at the same level, wherein the warp threads do not form a shed and all heddle frames can assume their highest or lowest positions or a position which lies therebetween.

In the case of punched-card-controlled dobbies, various methods are used to synchronize the heddle frames, including the following.

In one method, a thin sheet metal plate or a piece of imperforate card material is inserted between the pattern card with the perforated and nonperforated points and the reading needles. After this, the machine is permitted to run slowly until all heddle frames are in the lower shed position, namely, all needles have read a nonperforated point.

In a second method, all reading needles are lifted off from the card by one collective member, for example during the card indexing, and are held in this position until the slowly running machine has moved all heddle frames into the lower shed position. The lifting off of the reading needles is comparable to the reading of a nonperforated point.

In a third method, the card cylinder is moved directly away from the reading needles, so that they no longer can read the pattern card. Since this corresponds to the reading of a hole by every needle, all heddle frames move into the upper shed position as soon as the machine is operated for at least one pick or read.

In a fourth method, all draw hooks are suspended or removed manually by the same draw knife of a Hattersley dobby, through which one obtains the upper or lower shed positions of all the heddles frames.

A condition for achieving the desired synchronization by these methods is that the machine must be operated for at least one pick after the corresponding control manipulation of the reading needles. However, this has the result that the card cylinder which carries the pattern card is indexed in the normal manner. Thus, prior to resuming the weaving operation, the pattern card, namely the card cylinder with the dobby and the weaving machine, must be physically reset to the proper position, since otherwise the pick-logical or proper sequential operation is lacking because at least one pick following the last-entered pick prior to the synchronizing of the heddle frames will be skipped. The careful and exact adjustment of the cards requires a relatively large time input, and in cases of lack of proficiency or carelessness, errors can also occur.

The purpose of the invention is to carry out the synchronization or levelling of the heddle frames in a manner so that the continuation of the weaving operation occurs automatically and pick-logically without the need, prior to restarting the dobby, to manually reset the pattern card to the last-entered pick.

SUMMARY OF THE INVENTION

This purpose is achieved by providing a dobby of the above-mentioned type, the heddle frames being synchronized through the weaving machine with the dobby or only the dobby being stopped and the drive cylinder of the pattern card and/or the reading needles being moved relative to each other to a position in which the reading needles, during the reading operation, engage webs between the control holes in the pattern card and the drive cylinder of the pattern card is uncoupled from the dobby drive and is locked in position. The dobby is then operated until all heddle frames have reached the same position, preferably the lower shed position. For further weaving, the locking of the card cylinder is released and the dobby drive is again coupled to the pattern card drive cylinder.

To attain the inventive purpose, the weaving machine with the dobby or only the dobby is stopped at the moment of the shed crossing and the drive for the pattern card cylinder is decoupled with a simultaneous locking of the cylinder against further rotation. After this, the dobby, possibly with the weaving machine, is operated in any desired direction until all heddle frames have reached the common position, preferably the lower shed position.

To restart the weaving operation, the dobby is moved to the position of the shed crossing of the heddle frames. The drive cylinder drive is, simultaneous with an unlocking of the cylinder, again coupled to the dobby drive and then the only partially carried out cylinder indexing is finished. All other operations take place normally in the usual sequence and there is no need for the weaver to pay attention to the logical pick sequence and reset the pattern card.

BRIEF DESCRIPTION OF THE DRAWINGS

FIG. 1 is a front view of the drive mechanism of a drive cylinder for a pattern card of a weaving machine and illustrates a hand lever which operates a coupling and locking mechanism, wherein a center position during intermittent indexing of the cylinder is illustrated;

FIG. 2 is a top view of the mechanism according to FIG. 1 with a rocking lever omitted for clarity and illustrating the hand lever in a rest position and ready for movement to effect locking;

DETAILED DESCRIPTION

Figure 4:
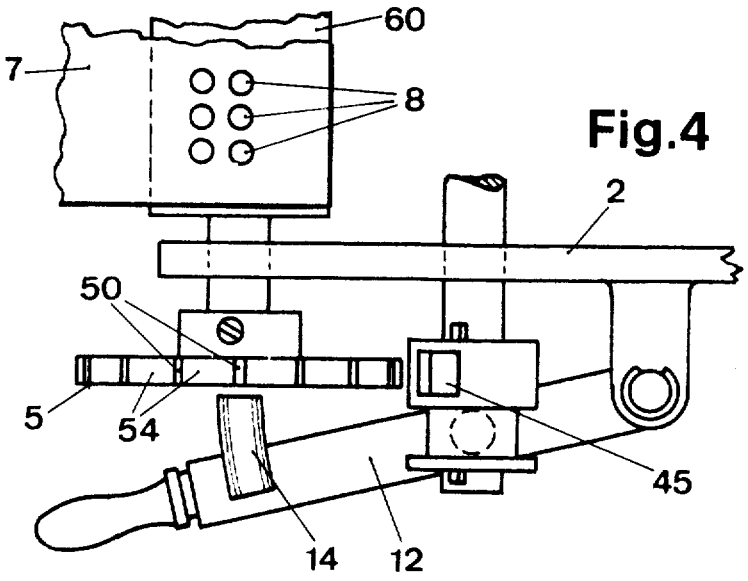
FIG. 4 is a top view similar to FIG. 2 illustrating the lever during a period between indexing of the drive cylinder.

Referring to FIG. 1, a sleeve 4 is axially movably supported on and is secured by a key 3 against rotation relative to an evenly, unevenly or intermittently rotating drive shaft 1 which is rotationally supported in a bearing plate 2 of a dobby. The sleeve 4 carries a driving projection 45 for engaging the teeth 50 of and indexing a rachet gear 5 which is fixedly secured on the shaft 6 of a drive cylinder 60 for a pattern card 7. The control points 8 (FIG. 2) on the pattern card consist of holes or nonperforated areas. The pattern card in FIGS. 2 nad 4 is shown with two lines of perforations for two successive picks or reads.

Since the driving projection 45 does not engage any tooth 50 of the gear 5 between two successive indexing movements of the ratchet gear 5, the ratchet gear 5 and thus the card cylinder 60 would be freely rotatable. Since, however, unintended rotary movement of the cylinder 60 can have significant consequences for the weaving operation, a roller 9 is rotationally supported as a locking member on one end of the ratchet or rocking lever 10, the other end of which is pivotally supported on a pin fixed on the plate 2. The roller 9 is urged by a tension spring 11, between indexing movements of the ratchet gear 5, into a tooth space 54.

A hand lever 12 which controls uncoupling and locking is pivotally supported on a pin 15 supported on the plate 2 of the dobby. The hand lever 12 has a tab 13 which engages an annular groove 46 provided on the sleeve 4, and a locking member 14 which is designed to engage a tooth space 54 of the ratchet gear 5. The locking member 14 is bent so as to have a curvature concentric with respect to the pin 15.

Figure 5:
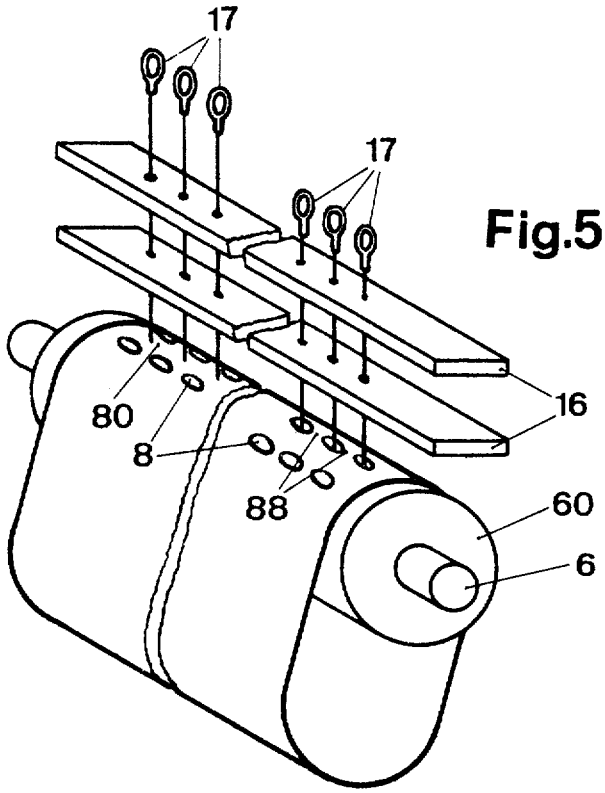
FIG. 5 is a perspective view of the drive cylinder of FIG. 1 and an associated pattern card and feeler needles, the left part illustrating the relative positions of these components corresponding to FIGS. 1–3 and the right part the relative positions corresponding to FIG. 4.

To provide a better understanding of the operation of the described mechanism, FIG. 5 is first explained. In dobbies of weaving machines using punched cards, it is standard for each hole in the card to mean the upper shed position of a heddle frame and a nonperforated point to mean the lower shed position. The three reading needles 17 illustrated in the right half of the FIG. 5 are each reading a hole, namely the needles are each lowered into a hole 8 of a line of perforations in the pattern card 7. The pattern card 7 rests on the drive cylinder 60 which is rotated continuously or intermittently by means of the shaft 6. Rails 16 are provided to axially guide the reading needles 17. The lifting mechanism is conventional and not illustrated, but is preferably similar to that disclosed in U.S. Pat. No. 3,285,291.

It is absolutely necessary, in order to effect indexing of the pattern card 7, to lift the reading needles 17 out of the holes 8. If, inventively, only a half of the usual indexing movement of the pattern card then occurs, then the reading needles 17 will lie, after being lowered, on the web 80 between the lines of perforations, as illustrated in the left half of FIG. 5. If the dobby and possibly the weaving machine meanwhile continue operating, then since the reading needles have all read a nonperforated point, all heddle frames will be moved to the lower shed position and one obtains the desired result.

The same result can also be achieved if, in place of a partial indexing of the drive cylinder of the pattern card, the cylinder 60 is moved half the interhole spacing axially or the rails 16 are moved this distance in a direction parallel to the shaft 6 so that the reading needles rest then on the webs 88 between the two rows of holes 8.

If now, by means of an arrangement according to FIGS. 1-4, synchronization or levelling of the heddle frames is to be effected, then one must start out from the normal operating position according to FIG. 4. One line of perforations 8 of the pattern card 7 is positioned precisely on top of the drive cylinder 60. Inadvertant rotation of the ratchet gear 5 is inhibited by engagement of the roller 9 (FIG. 1) in a tooth space 54. The locking member 14 of the hand lever 12 is aligned with a tooth 50, or in other words is between two tooth spaces 54. Thus, in FIG. 4, the hand lever 12 cannot and is not supposed to be pivoted. If the drive shaft 1 continues to rotate, then the driving projection 45 will move to engage a tooth space 54 and will begin to rotate the gear 5, whereby the roller 9 is lifted onto a tooth 50, as shown in FIG. 1. In the weaving machine, this position corresponds to the shed crossing. Thus, at this moment, the drive of the weaving machine and of the dobby must be interrupted.

In other words, the drive shaft 1 is stopped in the position shown in FIG. 1.

Figure 3:
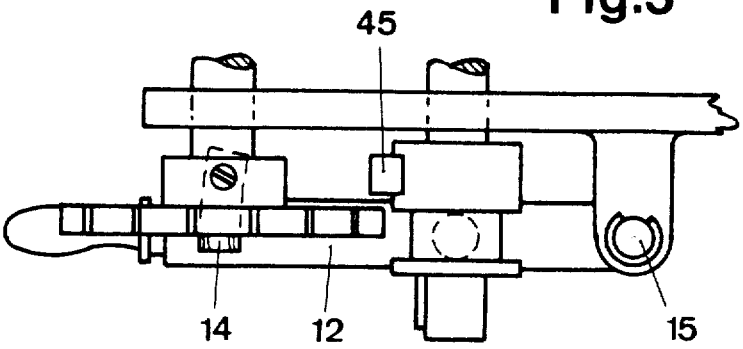
FIG. 3 is a top view similar to FIG. 2 illustrating the lever after its operation.

During manual swinging of the hand lever 12 from the position according to FIG. 2 to the position according to FIG. 3, the drive of the ratchet gear 5 is terminated, in that the sleeve 4 is moved axially on the drive shaft 1 through the engagement of the tab 13 and the annular groove 46, so that the driving projection 45 becomes disengaged from the tooth space 54.

Since the ratchet gear 5 would otherwise be freely rotatable, simultaneously with the disengagement of the driving projection 45 the locking member 14 moves into a tooth space 54 which is now aligned therewith. The drive cylinder 60 is thus locked in position, as illustrated in FIG. 3. In this position, the web 80 between two rows of perforations on the pattern card is positioned on the very top of the cylinder 60. All reading needles 17 can now read only a nonperforated point. Thus, upon further operation of the dobby, all heddle frames will be moved to the lower shed position.

In other words, the dobby, including the drive shaft 1, is restarted and is run until all heddle frames have been moved to the lower shed position. The dobby, including the drive shaft 1, is then stopped again so that the drive shaft 1 is in the position illustrated in FIG. 1.

To resume weaving, the hand lever 12 is swung from the position of FIG. 3 back to the position of FIG. 2. The locking of the ratchet gear 5 by the locking member 14 is thus released and the driving projection 45 again engages the same tooth space 54. The weaving machine thus resumes operation logically and without improper indexing.

Figure 8:
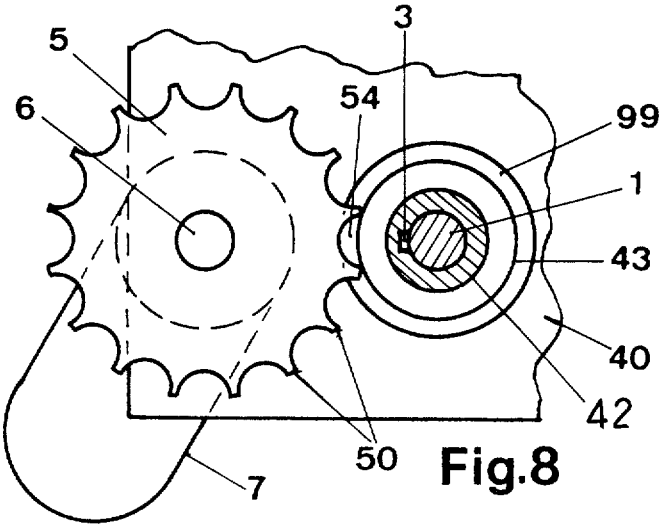
FIG. 8 is a sectional view along the line VIII—VIII of FIG. 7.
Figure 6:
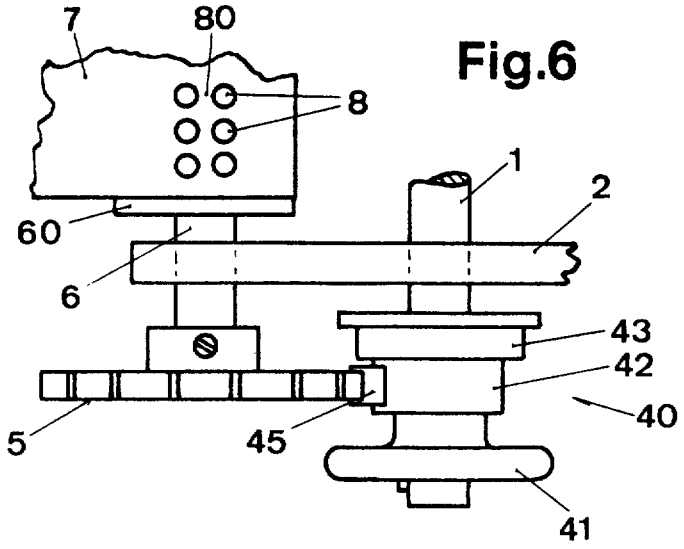
FIG. 6 is a top view of an alternative embodiment of the coupling and locking mechanism of FIG. 1 with a hand slide bar, during the indexing movement of the intermittently driven cylinder.
Figure 7:
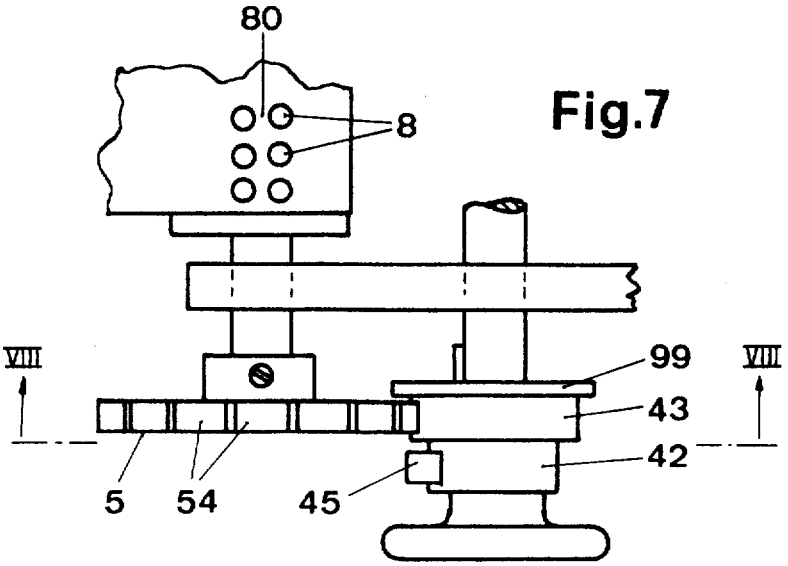
FIG. 7 is a view similar to FIG. 6 illustrating the same mechanism in the locking position.

In the arrangement according to FIGS. 6 and 7, a sleeve 40 is supported axially movably on the drive shaft 1, by which it is carried along rotationally due to a key. The sleeve has a handle 41 and two cylindrical sections 42 and 43 of different diameter. The driving projection 45 is provided on the section 42 which is smaller in diameter and, on each rotation of the shaft 1, rotates the ratchet gear 5 by the circumferential distance between two teeth 50 (FIG. 8). In the meantime, rotation of the ratchet gear 5 is prevented by a not-illustrated arrangement which is preferably similar to the lever 10 and roller 9 in FIG. 1.

If the shaft 1 is now stopped in the middle of indexing the rachet gear 5, then the sleeve 40 can be pulled outwardly on the shaft 1 a distance roughly equal to the width of the section 42. The driving projection 45 is thusly disengaged from the gear 5 and at the same time the larger cylindrical section 43 slides into a tooth space as shown in FIG. 8, causing the ratchet gear 5 to be locked against rotation. Thereafter, the reading needles 17, during reading, engage the web 80 betweem two lines of perforations, namely between two lines of control points. The axial movement of the sleeve 40 can only occur during the indexing movement of the gear 5 since, during the remaining time, the distance from the tip of one of the teeth 50 to the shaft 1 will be less than the radius of the larger section 43.

Figure 9:
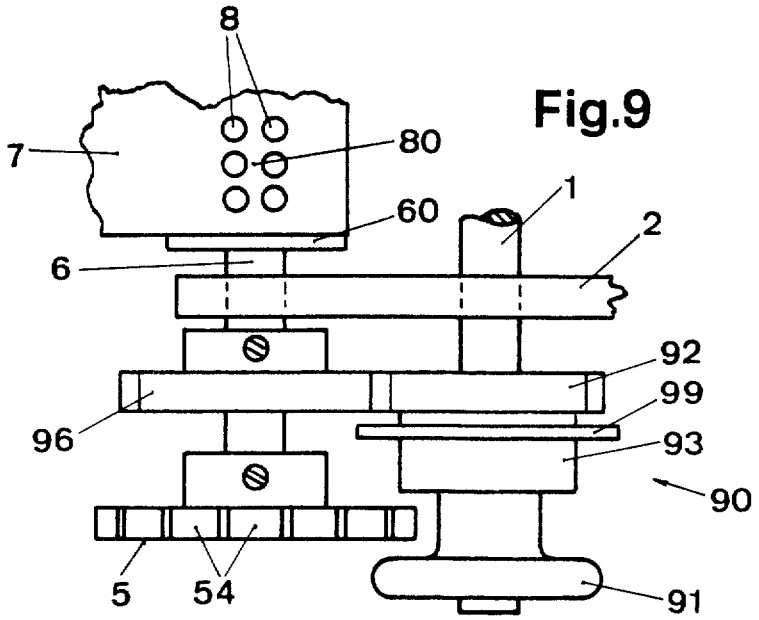
FIG. 9 is a top view of a further embodiment of the coupling and locking mechanism of FIG. 1 with a hand slide bar, in the coupled positon, which mechanism effects a continuous drive of the card cylinder.
Figure 10:
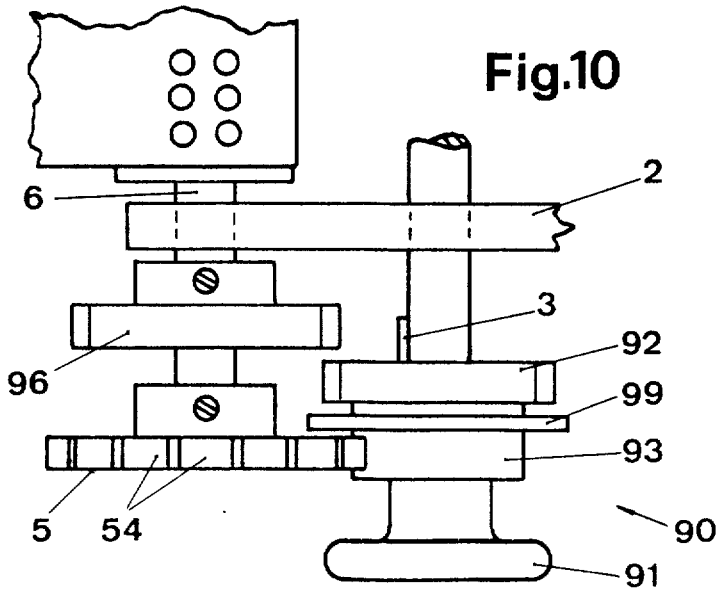
FIG. 10 is a view similar to FIG. 9 illustrating the mechanism in a position locking the drive cylinder for the pattern card.

In the arrangement according to FIGS. 9 and 10, a sleeve 90 which is axially movable on and is rotationally coupled to the shaft 1 by the key 3 is positioned on the drive shaft 1 which is rotationally supported in the bearing plate 2 of the dobby. The sleeve 90 includes a handle 91, a cylindrical section 93 and a drive gear 92 which mates with a gear 96 fixedly secured on the shaft 6 for the cylinder 60.

FIG. 9 illustrates the position of the handle 90 during normal operation of the weaving machine, the shaft 6 of the card cylinder 60 being continuously rotated by the drive shaft 1 through the two gears 92 and 96. In contrast to the embodiments which have been discussed up to now, the drive does not take place through a single driving projection such as the projection 45 of FIG. 1. Like the other embodiments, however, this new embodiment also stops the dobby at the time of the shed crossing. The web 80 between the lines of holes 8 in the pattern card lies along the very top of the card cylinder at this time. The sleeve 90 is moved sufficiently far on the shaft 1 by the handle 91 so that, on the one hand, the gears 92 and 96 disengage and, on the other hand, the cylindrical section 93 engages a tooth space 54 of the gear 5 to secure same against further rotation. A limitation of the axial movement of the sleeve 90 is provided by engagement of the disk 99 and gear 5.

The heddle frame driving mechanism continues to run in all illustrated and described examples after the uncoupling of the card cylinder drive in the middle of its indexing and the simultaneous locking of the same. All reading needles, in this position of the card cylinder, necessarily read a nonperforated point and, through further operation, cause all heddle frames to reach the lower shed position. After the unlocking and the recoupling, the dobby continues to work logically and without indexing errors without special attention, eve if it was operated for any desired number of picks or reads during the uncoupled state.

The renewed start can additionally be eased through indicating members, which synchronize the finding of the even and uneven picks during the return of the drive projection 45 and ease the resumption of the weaving operation. Further indicating members can facilitate the machine adjustment at which the gears 92 and 96 can again engage.

Instead of locking the drive cylinder of the pattern card in a center switching position, the dobby can alternatively be stopped in any desired position and then the reading needles or the card cylinder and pattern card can be moved for half a hole distance in a direction parallel to the axis of the card cylinder. During reading, the reading needles are then positioned on the webs between longitudinal rows of control or perforated points. The ultimate effect is the same.

Figure 11:
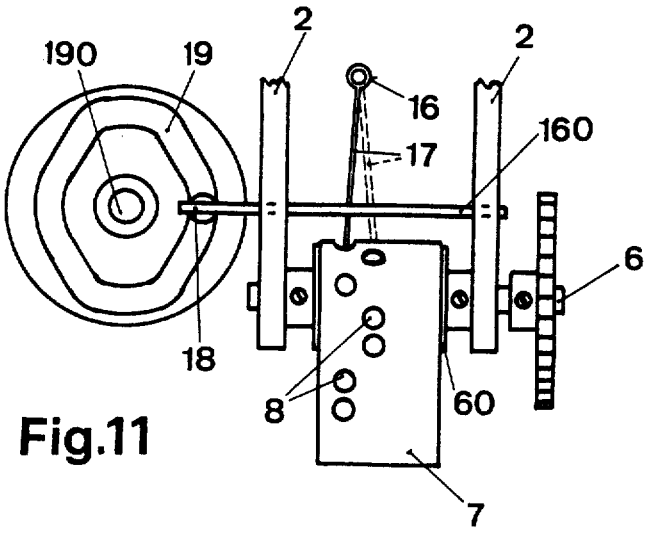
FIG. 11 is a side view illustrating a mechanism for effecting lateral shifting of the ends of the reading needles.

FIG. 11 illustrates a drive mechanism for such an axial movement, namely in connection with the example of the axial movement of the reading needles 17, which are supported by an upper fixed rail at 16 and guided by a lower movable guide member 160. The pattern card 7 is carried along by a cyliinder 60 of the shaft 6 which is rotationally supported in the walls 2 of the dobby. A cam follower 18 engages a cam groove 19 in a disk on a drive shaft 190 and effects lateral reciprocal movement of the guide member 160. A similar drive can alternatively effect axial movement of the drive cylinder of the pattern card relative to the reading needles 17.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for synchronizing all heddle frames of a weaving machine controlled by a dobby having a rotatably supported drive cylinder, a drive mechanism operatively coupled to said drive cylinder and adapted to successively index it to a plurality of predetermined angular positions, a pattern card operatively driven by said drive cylinder and having a plurality of rows of control points, said pattern card having perforations at a plurality of said control points, and a plurality of reading needles which are each supported for movement by said drive mechanism between a retracted position spaced from said pattern card and a reading position sensing a respective said control point of a said row of control points thereon, a respective said row of control points being aligned with said reading needles in each said prédetermined angular position, movement of each said heddle frame being controlled by a respective said reading needle, comprising the steps of uncoupling said drive mechanism from said drive cylinder when said drive cylinder is between two said predetermined positions; activating a locking mechanism which prevents rotation of said drive cylinder; thereafter operating said drive mechanism so that said reading needles move to said reading position, each said reading needle engaging said pattern card at a location which is between two said rows of control points and is thus free of perforations, which causes all said heddle frames to be moved to a common position; returning said reading needles to said retracted position; and thereafter deactivating said locking mechanism and recoupling said drive mechanism to said drive cylinder.

2. The method according to claim 1, including the steps of respectively stopping and starting said drive mechanism before and after said uncoupling step, and respectively stopping and starting said drive mechanism before and after said recoupling step.

3. The method according to claim 2, wherein said stopping steps each occur at the moment of a shed crossing.

4. In a method for synchronizing all heddle frames of a weaving machine controlled by a dobby which includes a movably supported pattern card having a plurality of rows of control points and perforations at a plurality of said control points, and a plurality of reading needles which are each supported for movement between a retracted position spaced from said pattern card and a reading position sensing a respective location thereon, movement of each said heddle frame being controlled by a respective said reading needle, including the step of successively moving said pattern card relative to said reading needles to a plurality of predetermined positions, each said reading needle being aligned with a respective said control point of a respective said row of control points in each said predetermined position, and the step of moving said reading needles to and from said reading position when said pattern card is in each said predetermined position, the improvement comprising the steps of moving said pattern card relative to said reading needles to a further position in which each said reading needle is aligned with a respective location on said pattern card which is spaced from said control points and is free of perforations, and then moving said reading needles to said reading position, so that all of said heddle frames are moved to a common position.

5. The method according to claim 4, including a rotatably supported drive cylinder which operatively drives said pattern card, said step of successively moving said pattern card being carried out by successively indexing said drive cylinder to a plurality of predetermined angular positions.

6. The method according to claim 5, wherein said drive cylinder for said pattern card is angularly positioned approximately intermediate two said predetermined angular positions when in said further position.

7. The method according to claim 5, wherein said step of moving said pattern card relative to said reading needles to said further position is carried out by moving said drive cylinder for said pattern card in an axial direction approximately half the distance between two adjacent control points in a said row of control points.

8. The method according to claim 5, wherein said step of moving said pattern card relative to said reading needles to said further position is carried out by moving the ends of said reading needles which engage said pattern card in a direction axially of said drive cylinder approximately half the distance between two adjacent control points in a said row of control points.

9. In a dobby for synchronizing all heddle frames of a weaving machine, including a pattern card supported for movement in a first direction, having a plurality of rows of control points extending in a second direction transverse to said first direction, and having perforations at a plurality of said control points; a plurality of reading needles which are each supported for movement between a retracted position spaced from said pattern card and a reading position sensing a respective said control point of a said row of control points thereon; and first means for successively indexing said pattern card to a plurality of predetermined positions, each of said reading needles being aligned with a respective said control point of a respective one of said rows of control points in each said predetermined position, said reading needles moving into and out of said reading position when said pattern card is positioned at each of said predetermined positions, said heddle frames being operatively coupled to respective said reading needles and moving in responsive thereto, the improvement comprising second means for selectively moving said pattern card relative to said reading needles to a further position in which each said reading needle is aligned with a respective location on said pattern card which is spaced from said control points and is free of perforations, said reading needles moving into and out of said reading position when said pattern card is in said further position and causing all said heddle frames to move to a common position.

10. The dobby according to claim 9, wherein said first means includes a rotatably supported drive cylinder which operatively engages and effects said movement of said pattern card and a drive mechanism which is drivingly coupled to said drive cylinder, wherein said reading needles are supported for lengthwise movement in a direction approximately radially of said drive cylinder, including means for selectively interrupting said driving coupling between said drive mechanism and said drive cylinder, and including means for releasably locking said drive cylinder in its angular position at the moment of such interruption.

11. The dobby according to claim 10, wherein said first means includes a rotatably supported support shaft on which said drive cylinder and a ratchet gear are fixed against rotation, including a rotatably supported drive shaft having a driving projection thereon which is fixed against rotation with respect thereto and engages the teeth of said ratchet gear as said drive shaft rotates to effect intermittent rotational movement of said support shaft and drive cylinder and thus said indexing movement of said pattern card, including third means for moving said driving projection relative to said ratchet gear to a disengaged position in which said projection is free of engagement with said ratchet gear in response to rotation of said drive shaft, and including a movable member having a locking member thereon and supported for movement between a position in which said locking member is spaced from said ratchet gear and a locking position in which said locking member engages a space between two teeth of said ratchet gear to lock said drive cylinder against rotation, said third means including means for effecting movement of said driving projection into and out of said disengaged position in response to movement of said movable member into and out of said locking position, said third means locking said drive cylinder against rotation approximately intermediate two said predetermined positions of said pattern card.

12. The dobby according to claim 11, wherein said driving projection is slidably supported on said drive shaft for axial movement between two positions, one of which is said disengaged position, and wherein said movable member is a lever which is pivotally supported on a dobby housing part and is operatively coupled to said driving projection for effecting axial movement of said driving projection along said drive shaft in response to pivotal movement of said lever.

13. The dobby according to claim 11, wherein said driving projection is provided on a sleeve which is axially slidably supported on said drive shaft but is fixed against rotation relative thereto, and wherein said sleeve in said movable member and has thereon, axially offset from said driving projection, said locking member, axial movement of said sleeve effecting said movement of said driving projection and said locking member into and out of said disengaged position and said locking position, respectively.

14. The dobby according to claim 13, wherein said sleeve is provided with manually engageable handle means for effecting said axial movement thereof.

15. The dobby according to claim 9, wherein said second means includes at least one guide member which has a plurality of openings in which respective said reading needles are slidably received, and which is supported for movement relative to said drive cylinder in a direction which is substantially parallel to one of said first and second directions.

16. The dobby according to claim 15, including a movably supported member having a cam surface thereon, wherein said guide member is movable in said second direction, and wherein said guide member includes a cam follower which cooperates with said cam surface to effect movement of said guide member in response to movement of said movable member.

17. The dobby according to claim 9, wherein said drive cylinder for said pattern card is supported for axial movement between two positions which are spaced by approximately half the distance between two adjacent control points in a said row of control points on said pattern card.

18. The dobby according to claim 11, including a lever pivotally supported at one end on a dobby housing part, a roller rotationally supported on the other end of said lever and adjacent said ratchet gear, and resilient means cooperable with said lever for urging said roller into engagement with a space between two adjacent teeth on said ratchet gear in order to yieldably resist rotation of said ratchet gear.

* * * * *